US008328951B2

(12) United States Patent
Bastigkeit et al.

(10) Patent No.: US 8,328,951 B2
(45) Date of Patent: Dec. 11, 2012

(54) CLEANING AGENT

(75) Inventors: Thorsten Bastigkeit, Wuppertal (DE); Arnd Kessler, Monheim am Rhein (DE); Christian Nitsch, Dusseldorf (DE); Johannes Zipfel, Dusseldorf (DE); Dorota Sendor-Muller, Dusseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/248,246

(22) Filed: Sep. 29, 2011

(65) Prior Publication Data

US 2012/0021965 A1 Jan. 26, 2012

Related U.S. Application Data

(63) Continuation of application No. PCT/EP2010/054305, filed on Mar. 31, 2010.

(30) Foreign Application Priority Data

Apr. 1, 2009 (DE) ..... 10 2009 002 095

(51) Int. Cl.
*B08B 9/20* (2006.01)
*C11D 17/00* (2006.01)

(52) U.S. Cl. ..... 134/25.2; 510/220; 510/276; 8/137
(58) Field of Classification Search ..... None
See application file for complete search history.

(56) References Cited

U.S. PATENT DOCUMENTS 4,305,837 A * 12/1981 Kaminsky et al. ..... 510/393

FOREIGN PATENT DOCUMENTS

| | | | |
|---|---|---|---|
| DE | 2038103 | A1 | 2/1972 |
| DE | 19717329 | A1 | 10/1998 |
| DE | 102005062479 | A1 | 7/2007 |
| EP | 0730024 | B1 | 10/1999 |
| EP | 1081215 | B1 | 3/2004 |
| EP | 1717303 | B1 | 11/2008 |
| EP | 1759624 | B1 | 3/2010 |

OTHER PUBLICATIONS

PCT International Search Report (PCT/EP2010/054305) dated Jul. 16, 2010.

* cited by examiner

*Primary Examiner* — Necholus Ogden, Jr.
(74) *Attorney, Agent, or Firm* — David K. Benson

(57) ABSTRACT

Liquid detergent or cleaning agent preparations include a) at least 5 wt % of at least one enzyme preparation active in washing or cleaning; and b) at least 0.5 wt % cumene-sulfonate, wherein the liquid detergent or cleaning agent preparations are characterized by a good phase stability and enzyme stability and good cleaning performance.

8 Claims, No Drawings

CLEANING AGENT

CROSS-REFERENCES TO RELATED APPLICATIONS

This application is a continuation of Application No. PCT/EP2010/054305, filed on Mar. 31, 2010, which claims priority under 35 U.S.C. §119 to DE 10 2009 002 095.0 filed on Apr. 1, 2009, both of which are incorporated herein by reference.

FIELD OF THE INVENTION

The present invention generally relates to washing and cleaning agents, and more particularly relates to washing and cleaning agents that contain enzymes.

BACKGROUND OF THE INVENTION

The manufactured forms and presentation forms of washing and cleaning agents are constantly subject to new modifications. In this regard, a main focus for some time has been on the convenient metering of washing and cleaning agents and the simplification of the process stages required for carrying out a washing or cleaning process.

In this context, devices for the multi-dosing of washing and cleaning agents have recently become a focus of attention for the product developer. For these devices one can differentiate between, on the one hand metering containers that are integrated into the automatic dishwasher or washing machine, and on the other hand devices that are independent from the automatic dishwasher or washing machine. In the course of a plurality of sequential cleaning stages portions of detergent or cleaning agent are automatically or semi-automatically metered into the interior of the cleaning machine by these devices that contain the multiple doses of cleaning agent required for carrying out a cleaning process. The consumer no longer needs to dose the cleaning agent prior to each individual cleaning operation. Examples of such devices are described in the European patent application EP 1 759 624 A2 (Reckitt Benckiser) or in the German patent application DE 10 2005 062 479 A1 (BSH Bosch and Siemens Hausgeräte GmbH).

Independently of the exact design of the metering device placed in the interior of the automatic dishwashers or washing machines, the washing or cleaning agents that are contained in these devices for multiple metering are exposed for a long period of time, in particular to varying temperatures, these temperatures being approximately equivalent to the temperatures of the water used for carrying out the washing or cleaning process. These temperatures can be up to 95° C., wherein in automatic dishwashing usually temperatures between 50 and 75° C. are attained. In the course of multiple laundry or cleaning processes a washing or cleaning agent contained in a device intended for multiple dosing will therefore be repeatedly heated to temperatures significantly above those that are usual for transportation and storage; temperature-sensitive, active substances will be particularly affected. The group of these temperature-sensitive active washing and cleaning substances includes primarily the active washing and cleaning enzymes.

The use of enzymes to improve the laundry and cleaning power of washing and cleaning agents has been established in the prior art for some decades. In particular, hydrolytic enzymes such as proteases, amylases or lipases, due to their direct cleaning action, are a component of numerous cleaning agents for fabrics or table ware.

Proteases, especially serine proteases, to which the subtilases are also associated according to the invention, serve to degrade protein-containing stains on the product being cleaned. Subtilases, due to their favorable enzymatic properties, such as stability or pH optimum, have a preeminent position among the washing and cleaning proteases. From the amylase enzyme class, the α-amylases are prevalent; α-amylases (E.C. 3.2.1.1) hydrolyze internal α-1,4-glycosidic bonds of starch and starch-like polymers.

In the washing and cleaning agents, the cleaning action of the incorporated enzyme which is decisive for the consumer, is also determined, in addition to the enzyme structure, to a significant degree by the type of packaging of the enzyme and its stabilization against environmental influences.

Active washing and cleaning enzymes are made up both in solid as well as in liquid form. The group of solid enzyme preparations includes in particular the enzyme granulates that consist of a plurality of ingredients and which are preferably incorporated into solid washing and cleaning agents. On the other hand, liquid or gel type washing and cleaning agents frequently comprise liquid enzyme preparations, these being much less protected against external influences than the enzyme granulates.

A series of different protective measures have been proposed in order to increase the stability of these types of enzyme-containing liquid washing or cleaning agents. Thus, for example, the German patent application DE 2 038 103 (Henkel) teaches the stabilization of enzyme-containing dishwashing agents by saccharides, whereas propylene glycol is disclosed in the European patent EP 646 170 B1 (Procter & Gamble) for stabilizing enzymes in liquid cleaning agents.

The hitherto found methods described in the prior art for stabilizing enzymes take into account only to a limited extent the problematic nature of repeated exposure to high temperatures, as for example occur in the above described devices for multiple dosing of washing or cleaning agents. The previously known methods are only suitable to a limited extent for avoiding a loss of activity or for avoiding segregation of the enzyme in liquid cleaning agents.

Accordingly, it is desirable to stabilize an active washing or cleaning enzyme preparation against phase separation/loss of activity during multiple variations in temperature, in particular in a temperature range of 10 to 75° C. It is further desirable to enable enzyme preparations to be storable without significant loss of activity in a storage device located in the interior of the automatic dishwasher or washing machine.

Furthermore, other desirable features and characteristics of the present invention will become apparent from the subsequent detailed description of the invention and the appended claims, taken in conjunction with the accompanying drawings and this background of the invention.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

It was surprisingly found that liquid enzyme preparations can be stabilized by the addition of a specific hydrotrope.

Accordingly, a first embodiment of this invention is a liquid washing or cleaning agent preparation A, comprising a) at least 5 wt. % of at least one active washing or cleaning enzyme preparation; and b) at least 0.5 wt. % cumene sulfonate.

The subject matter of this application is liquid washing or cleaning agent preparations. The liquid washing or cleaning agent preparations A preferably contain water. Particularly preferred washing or cleaning agent preparations A are those wherein the weight fraction of the water is between 2 and 20 wt. %, preferably between 4 and 18 wt. % and in particular between 5 and 15 wt. %, each relative to the total weight of the washing or cleaning agent preparation.

The washing or cleaning agent preparations according to the invention comprise at least one active washing or cleaning enzyme as their first key ingredient. The weight fraction of the active washing or cleaning enzyme in the total weight of the washing or cleaning agent preparation is advantageously between 5 and 80 wt. %, preferably between 5 and 60 wt. %, particularly preferably between 10 and 50 wt. % and especially between 10 and 30 wt. %.

Particularly preferred added enzymes particularly include proteases, amylases, lipases, hemicellulases, cellulases, perhydrolases or oxidoreductases, as well as preferably their mixtures. In principle, these enzymes are of natural origin; improved variants based on the natural molecules are available for use in washing or cleaning agents and accordingly they are preferably employed. The washing or cleaning agents preferably comprise enzymes in total quantities of $1\times10^{-6}$ to 5 wt. % based on active protein. The protein concentration can be determined using known methods, for example the BCA process or the biuret process.

The stabilizing action according to the invention was observed to a particular degree with the amylases and the proteases; therefore liquid washing or cleaning agent preparations according to the invention comprising an active washing or cleaning enzyme from the group of the amylases and/or proteases are preferred.

Preferred proteases are those of the subtilisin type. Examples of these are the subtilisins BPN' and Carlsberg as well as their further developed forms, the protease PB92, the subtilisins 147 and 309, the alkaline protease from *Bacillus lentus*, subtilisin DY and those enzymes of the subtilases no longer however classified in the stricter sense as the subtilisins: thermitase, proteinase K and the proteases TW3 and TW7.

Preferred liquid washing or cleaning agent preparations A according to the invention comprise 5 to 50 wt. %, preferably 7 to 40 wt. % and in particular 10 to 30 wt. % protease preparations, relative to the total weight of the washing or cleaning agent preparation A. Washing or cleaning agent preparations A that, relative to their total weight, comprise 15 to 25 wt. % of protease preparations are particularly preferred.

Examples of further useable amylases according to the invention are the α-amylases from *Bacillus licheniformis*, from *B. amyloliquefaciens*, from *B. stearothermophilus*, from *Aspergillus niger* and *A. oryzae* as well as the improved further developments of the cited amylases for use in washing and cleaning agents. Moreover, for this purpose, attention should be drawn to the α-amylase from *Bacillus* sp. A 7-7 (DSM 12368) and the cyclodextrin-glucanotransferase (CGTase) from *B. agaradherens* (DSM 9948).

Inventively preferred liquid washing or cleaning agent preparations A comprise 0.1 to 30 wt. %, preferably 1.0 to 25 wt. % and in particular 2.0 to 20 wt. % of amylase preparations, relative to the total weight of the washing or cleaning agent preparation A. Washing or cleaning agent preparations A that, relative to their total weight, comprise 4.0 to 16 wt. % of amylase preparations are particularly preferred.

Active washing or cleaning proteases and amylases are generally not made available in the form of the pure protein but rather in the form of stabilized, storable and transportable preparations. These prefabricated preparations include, for example, solid preparations obtained by granulation, extrusion or lyophilization, or particularly for liquid compositions or gel-type compositions, enzyme solutions, advantageously as highly concentrated as possible, of low moisture content and/or mixed with stabilizers or further adjuvants.

Alternatively the enzymes, both for the solid as well as for the liquid application form, can be encapsulated, for example by spray drying or extrusion of the enzyme solution together with a preferably natural polymer or in the form of capsules, for example those, in which the enzyme is embedded in a solidified gel, or in those of the core-shell type, in which an enzyme-containing core is coated with a water-, air- and/or chemical-impervious protective layer. Further active principles, for example stabilizers, emulsifiers, pigments, bleaches or colorants can be applied in additional layers. Such capsules are made using known methods, for example by vibratory granulation or roll compaction or by fluidized bed processes. Advantageously, these types of granulates, for example with a coated polymeric film former, are dust-free and as a result of the coating are storage stable.

In addition, it is possible to formulate two or more enzymes together, so that a single granulate exhibits a plurality of enzymatic activities.

As the preceding examples demonstrate, the enzyme protein forms only a fraction of the total weight of customary enzyme preparations. Inventively preferred added protease and amylase preparations comprise between 0.1 and 40 wt. %, preferably between 0.2 and 30 wt. %, particularly preferably between 0.4 and 20 wt. % and especially between 0.8 and 10 wt. % of the enzyme protein.

According to the invention, lipases or cutinases can also be incorporated, particularly due to their triglyceride cleaving activities, but also in order to produce in situ peracids from suitable preliminary steps. These include for example the available or further developed lipases originating from *Humicola lanuginosa* (*Thermomyces lanuginosus*), particularly those with the amino acid substitution D96L. Moreover, suitable cutinases, for example are those that were originally isolated from *Fusarium solani* pili and *Humicola insolens*. Further suitable are lipases or cutinases whose starting enzymes were originally isolated from *Pseudomonas mendocina* and *Fusarium solanii*.

In addition, enzymes, which are summarized under the term hemicellulases, can be added. These include, for example mannanases, xanthanlyases, pectinlyases (=pectinases), pectinesterases, pectatlyases, xyloglucanases (=xylanases), pullulanases and β-glucanases.

To increase the bleaching action, oxidoreductases, for example oxidases, oxygenases, catalases, peroxidases, like halo-, chloro-, bromo-, lignin-, glucose- or manganese-peroxidases, dioxygenases or laccases (phenoloxidases, polyphenoloxidases) can be incorporated according to the invention. Advantageously, additional, preferably organic, particularly preferably aromatic compounds are added that interact with the enzymes to enhance the activity of the relevant oxidoreductases (enhancers) or to facilitate the electron flow (mediators) between the oxidizing enzymes and the stains over strongly different redox potentials.

A plurality of enzymes and/or enzyme preparations, preferably liquid protease preparations and/or amylase preparations, are preferably added.

A second key ingredient of the washing or cleaning agent preparation according to the invention is the cumene sulfonate. For the cumene sulfonates, the para-isopropyl benzene sulfonate is the preferred compound.

The cumene sulfonate surprisingly proved to be superior in regard to its stabilizing properties not only against solvents such as glycerin, triacetin or diethylene glycol, but also against hydrotropes such as xylene sulfonate. In fact, an adequate stabilization of the enzyme-containing washing or cleaning preparation A could not be realized with any other substance.

Preferred liquid washing or cleaning agent preparations A comprise the cumene sulfonate in amounts of 0.5 to 60 wt. %, advantageously in amounts between 1.0 and 50 wt. %, preferably in amounts between 2.0 and 40 wt. % and in particular in amounts between 5.0 and 30 wt. %, each relative to the total weight of the washing or cleaning agent preparations. The weight fractions of the cumene sulfonate in the total weight of the washing or cleaning agent preparation A are particularly preferably between 2.0 and 20 wt. %, preferably between 3.0 and 18 wt. %, in particular between 4.0 and 15 wt. %.

Another preferred ingredient of the washing or cleaning agent preparations A according to the invention is an organic solvent. Preferred organic solvents come from the group of the mono- or polyhydric alcohols, alkanolamines or glycol ethers. Preferably, the solvents are selected from ethanol, n- or i-propanol, butanol, glycol, propanediol or butanediol, glycerin, diglycol, propyl diglycol or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl-, -ethyl- or -propyl ether, dipropylene glycol methyl-, or -ethyl ether, methoxy-, ethoxy- or butoxy triglycol, 1-butoxyethoxy-2-propanol, 3-methyl-3-methoxybutanol, propylene glycol t-butyl ether as well as mixtures of these solvents. The weight fraction of these organic solvents in the total weight of the inventive washing or cleaning preparations A is advantageously 5 to 80 wt. %, preferably 10 to 60 wt. % and especially 20 to 50 wt. %.

A particularly preferred, and in regard to the stabilization of the washing or cleaning preparation, a particularly effective organic solvent is 1,2-propylene glycol. The weight fraction of the 1,2-propylene glycol to the total weight of the washing or cleaning agent preparations A according to the invention can vary over wide limits, although those preparations have proved to be particularly stable which comprise an organic solvent, preferably 1,2-propylene glycol, wherein the weight fraction of the 1,2-propylene glycol is advantageously 5 to 80 wt. %, preferably 10 to 60 wt. % and in particular 20 to 50 wt. %, each relative to the total weight of the washing or cleaning agent preparations.

A second preferred ingredient of the washing or cleaning agent preparations according to the invention is boric acid or the boric acid derivative c). Besides boric acids, especially boronic acids or their salts or esters are preferably used in this regard, above all derivatives with aromatic groups, for example ortho, meta or para substituted phenyl boronic acids, particularly 4-formylphenyl boronic acid (4-FPBA), or the salts or esters of the cited compounds. The weight fraction of the boric acid or the boric acid derivatives in the total weight of the inventive washing or cleaning preparations is preferably between 0.001 to 10 wt. %, preferably 0.002 to 6 wt. % and especially 0.05 to 3 wt. %.

A particularly preferred, and in regard to the stabilization of the washing or cleaning preparation, a particularly effective boric acid derivative is 4-formylphenyl boronic acid. The weight fraction of the 4-formylphenyl boronic acid in the total weight of the washing or cleaning agent preparations A according to the invention can vary over wide limits, although those preparations have proved to be particularly stable which comprise 0.001 to 10 wt. %, preferably 0.002 to 6 wt. % and in particular 0.05 to 3 wt. %, relative to the total weight of the washing or cleaning agent preparation A. Corresponding preparations are consequently inventively preferred.

A third preferred ingredient of the washing or cleaning agent preparations according to the invention is a Ca or Mg ion source d). The weight fraction of the Ca or Mg ion source in the total weight of the inventive washing or cleaning preparations is preferably between 0.01 to 10 wt. %, preferably 0.2 to 8 wt. % and especially 0.5 to 5 wt. %.

Particularly preferred and in regard to the stabilization of the washing or cleaning preparation particularly effective sources of Ca ions have proven to be the organic calcium salts. The weight fraction of the organic calcium source in the total weight of the washing or cleaning agent preparations A according to the invention can vary over wide limits, although those preparations have proved to be particularly stable which comprise 0.01 to 10 wt. %, preferably 0.2 to 8 wt. % and in particular 0.5 to 5 wt. % relative to the total weight of the washing or cleaning agent preparation. Corresponding preparations are consequently inventively preferred. Calcium lactate is a quite particularly preferred organic calcium salt.

In addition, polyols, especially sorbitol, can also be comprised in inventively preferred washing or cleaning agent preparations A for stabilizing the washing or cleaning preparation. Polyols, especially sorbitol, are here preferably comprised in amounts of 1 to 20 wt. %, especially 2 to 15 wt. %, above all 2 to 10 wt. %.

The composition of some exemplary washing or cleaning agent preparations A according to the invention can be found in the following Tables:

TABLE 1

| | Formulation 1 | Formulation 2 | Formulation 3 | Formulation 4 | Formulation 5 |
|---|---|---|---|---|---|
| Amylase preparation | 5.0 to 30 | 5. 0 to 25 | 5.0 to 25 | 5.0 to 20 | 5.0 to 20 |
| Protease preparation | | — | — | — | — |
| Cumene sulfonate | 0.5 to 60 | 1.0 to 50 | 2.0 to 40 | 2.0 to 40 | 5.0 to 30 |
| Organic solvent | 0 to 80 | 0 to 80 | 0 to 60 | 0 to 60 | 0 to 50 |
| Boric acid derivative | 0 to 10 | 0 to 10 | 0 to 6 | 0 to 6 | 0 to 3.0 |
| Ca ion source | 0 to 10 | 0 to 8 | 0 to 8 | 0 to 8 | 0 to 5 |
| Misc. | ad 100 | ad 100 | ad 100 | ad 100 | ad 100 |

"—" means, in this and in all subsequent Tables: the formulation is free of this ingredient

TABLE 2

| | Formulation 1 | Formulation 2 | Formulation 3 | Formulation 4 | Formulation 5 |
|---|---|---|---|---|---|
| Amylase preparation | 5.0 to 30 | 5.0 to 25 | 5.0 to 25 | 5.0 to 20 | 5.0 to 20 |
| Protease preparation | — | — | — | — | — |
| Cumene sulfonate | 0.5 to 60 | 1.0 to 50 | 2.0 to 40 | 2.0 to 40 | 5.0 to 30 |
| Organic solvent | 5.0 to 80 | 5.0 to 80 | 10 to 60 | 10 to 60 | 20 to 50 |
| Boric acid derivative | 0.001 to 10 | 0.001 to 10 | 0.002 to 6 | 0.002 to 6 | 0.05 to 3.0 |
| Ca ion source | 0.01 to 10 | 0.2 to 8 | 0.2 to 8 | 0.2 to 8 | 0.5 to 5 |
| Misc. | ad 100 | ad 100 | ad 100 | ad 100 | ad 100 |

TABLE 3

| | Formulation 1 | Formulation 2 | Formulation 3 | Formulation 4 | Formulation 5 |
|---|---|---|---|---|---|
| Amylase preparation | 5.0 to 30 | 5.0 to 25 | 5.0 to 25 | 5.0 to 20 | 5.0 to 20 |
| Protease preparation | — | — | — | — | — |
| Cumene sulfonate | 0.5 to 60 | 1.0 to 50 | 2.0 to 40 | 2.0 to 40 | 5.0 to 30 |
| 1,2-propylene glycol | 0 to 80 | 0 to 80 | 0 to 60 | 0 to 60 | 0 to 50 |
| 4-FPBA | 0 to 10 | 0 to 10 | 0 to 6 | 0 to 6 | 0 to 3.0 |
| Org. calcium salt | 0 to 10 | 0 to 8 | 0 to 8 | 0 to 8 | 0 to 5 |
| Misc. | ad 100 | ad 100 | ad 100 | ad 100 | ad 100 |

TABLE 4

| | Formulation 1 | Formulation 2 | Formulation 3 | Formulation 4 | Formulation 5 |
|---|---|---|---|---|---|
| Amylase preparation | 5.0 to 30 | 5.0 to 25 | 5.0 to 25 | 5.0 to 20 | 5.0 to 20 |
| Protease preparation | — | — | — | — | — |
| Cumene sulfonate | 0.5 to 60 | 1.0 to 50 | 2.0 to 40 | 2.0 to 40 | 5.0 to 30 |
| 1,2-propylene glycol | 5.0 to 80 | 5.0 to 80 | 10 to 60 | 10 to 60 | 20 to 50 |
| 4-FPBA | 0.001 to 10 | 0.001 to 10 | 0.002 to 6 | 0.002 to 6 | 0.05 to 3.0 |
| Org. calcium salt | 0.01 to 10 | 0.2 to 8 | 0.2 to 8 | 0.2 to 8 | 0.5 to 5 |
| Misc. | ad 100 | ad 100 | ad 100 | ad 100 | ad 100 |

TABLE 5

| | Formulation 1 | Formulation 2 | Formulation 3 | Formulation 4 | Formulation 5 |
|---|---|---|---|---|---|
| Amylase preparation | — | — | — | — | — |
| Protease preparation | 5.0 to 50 | 7.0 to 40 | 7.0 to 40 | 10 to 30 | 10 to 30 |
| Cumene sulfonate | 0.5 to 60 | 1.0 to 50 | 2.0 to 40 | 2.0 to 40 | 5.0 to 30 |
| Organic solvent | 0 to 80 | 0 to 80 | 0 to 60 | 0 to 60 | 0 to 50 |
| Boric acid derivative | 0 to 10 | 0 to 10 | 0 to 6 | 0 to 6 | 0 to 3.0 |
| Ca ion source | 0 to 10 | 0 to 8 | 0 to 8 | 0 to 8 | 0 to 5 |
| Misc. | ad 100 | ad 100 | ad 100 | ad 100 | ad 100 |

TABLE 6

| | Formulation 1 | Formulation 2 | Formulation 3 | Formulation 4 | Formulation 5 |
|---|---|---|---|---|---|
| Amylase preparation | | | | | |
| Protease preparation | 5.0 to 50 | 7.0 to 40 | 7.0 to 40 | 10 to 30 | 10 to 30 |
| Cumene sulfonate | 0.5 to 60 | 1.0 to 50 | 2.0 to 40 | 2.0 to 40 | 5.0 to 30 |
| Organic solvent | 5.0 to 80 | 5.0 to 80 | 10 to 60 | 10 to 60 | 20 to 50 |
| Boric acid derivative | 0.001 to 10 | 0.001 to 10 | 0.002 to 6 | 0.002 to 6 | 0.05 to 3.0 |
| Ca ion source | 0.01 to 10 | 0.2 to 8 | 0.2 to 8 | 0.2 to 8 | 0.5 to 5 |
| Misc. | ad 100 | ad 100 | ad 100 | ad 100 | ad 100 |

TABLE 7

| | Formulation 1 | Formulation 2 | Formulation 3 | Formulation 4 | Formulation 5 |
|---|---|---|---|---|---|
| Amylase preparation | — | — | — | — | — |
| Protease preparation | 5.0 to 50 | 7.0 to 40 | 7.0 to 40 | 10 to 30 | 10 to 30 |
| Cumene sulfonate | 0.5 to 60 | 1.0 to 50 | 2.0 to 40 | 2.0 to 40 | 5.0 to 30 |
| 1,2-propylene glycol | 0 to 80 | 0 to 80 | 0 to 60 | 0 to 60 | 0 to 50 |
| 4-FPBA | 0 to 10 | 0 to 10 | 0 to 6 | 0 to 6 | 0 to 3.0 |
| Org. calcium salt | 0 to 10 | 0 to 8 | 0 to 8 | 0 to 8 | 0 to 5 |
| Misc. | ad 100 | ad 100 | ad 100 | ad 100 | ad 100 |

TABLE 8

| | Formulation 1 | Formulation 2 | Formulation 3 | Formulation 4 | Formulation 5 |
|---|---|---|---|---|---|
| Amylase preparation | — | — | — | — | — |
| Protease preparation | 5.0 to 50 | 7.0 to 40 | 7.0 to 40 | 10 to 30 | 10 to 30 |
| Cumene sulfonate | 0.5 to 60 | 1.0 to 50 | 2.0 to 40 | 2.0 to 40 | 5.0 to 30 |
| 1,2-propylene glycol | 5.0 to 80 | 5.0 to 80 | 10 to 60 | 10 to 60 | 20 to 50 |
| 4-FPBA | 0.001 to 10 | 0.001 to 10 | 0.002 to 6 | 0.002 to 6 | 0.05 to 3.0 |
| Org. calcium salt | 0.01 to 10 | 0.2 to 8 | 0.2 to 8 | 0.2 to 8 | 0.5 to 5 |
| Misc. | ad 100 | ad 100 | ad 100 | ad 100 | ad 100 |

TABLE 9

| | Formulation 1 | Formulation 2 | Formulation 3 | Formulation 4 | Formulation 5 |
|---|---|---|---|---|---|
| Amylase preparation | 5.0 to 30 | 5.0 to 25 | 5.0 to 25 | 5.0 to 20 | 5.0 to 20 |
| Protease preparation | 5.0 to 50 | 7.0 to 40 | 7.0 to 40 | 10 to 30 | 10 to 30 |
| Cumene sulfonate | 0.5 to 60 | 1.0 to 50 | 2.0 to 40 | 2.0 to 40 | 5.0 to 30 |
| Organic Solvent | 0 to 80 | 0 to 80 | 0 to 60 | 0 to 60 | 0 to 50 |
| Boric acid derivative | 0 to 10 | 0 to 10 | 0 to 6 | 0 to 6 | 0 to 3.0 |
| Ca ion source | 0 to 10 | 0 to 8 | 0 to 8 | 0 to 8 | 0 to 5 |
| Misc. | ad 100 | ad 100 | ad 100 | ad 100 | ad 100 |

TABLE 10

| | Formulation 1 | Formulation 2 | Formulation 3 | Formulation 4 | Formulation 5 |
|---|---|---|---|---|---|
| Amylase preparation | 5.0 to 30 | 5.0 to 25 | 5.0 to 25 | 5.0 to 20 | 5.0 to 20 |
| Protease preparation | 5.0 to 50 | 7.0 to 40 | 7.0 to 40 | 10 to 30 | 10 to 30 |
| Cumene sulfonate | 0.5 to 60 | 1.0 to 50 | 2.0 to 40 | 2.0 to 40 | 5.0 to 30 |
| Organic solvent | 5.0 to 80 | 5.0 to 80 | 10 to 60 | 10 to 60 | 20 to 50 |
| Boric acid derivative | 0.001 to 10 | 0.001 to 10 | 0.002 to 6 | 0.002 to 6 | 0.05 to 3.0 |
| Ca ion source | 0.01 to 10 | 0.2 to 8 | 0.2 to 8 | 0.2 to 8 | 0.5 to 5 |
| Misc. | ad 100 | ad 100 | ad 100 | ad 100 | ad 100 |

TABLE 11

| | Formulation 1 | Formulation 2 | Formulation 3 | Formulation 4 | Formulation 5 |
|---|---|---|---|---|---|
| Amylase preparation | 5.0 to 30 | 5.0 to 25 | 5.0 to 25 | 5.0 to 20 | 5.0 to 20 |
| Protease preparation | 5.0 to 50 | 7.0 to 40 | 7.0 to 40 | 10 to 30 | 10 to 30 |
| Cumene sulfonate | 0.5 to 60 | 1.0 to 50 | 2.0 to 40 | 2.0 to 40 | 5.0 to 30 |
| 1,2-propylene glycol | 0 to 80 | 0 to 80 | 0 to 60 | 0 to 60 | 0 to 50 |
| 4-FPBA | 0 to 10 | 0 to 10 | 0 to 6 | 0 to 6 | 0 to 3.0 |
| Org. calcium salt | 0 to 10 | 0 to 8 | 0 to 8 | 0 to 8 | 0 to 5 |
| Misc. | ad 100 | ad 100 | ad 100 | ad 100 | ad 100 |

TABLE 12

| | Formulation 1 | Formulation 2 | Formulation 3 | Formulation 4 | Formulation 5 |
|---|---|---|---|---|---|
| Amylase preparation | 5.0 to 30 | 5.0 to 25 | 5.0 to 25 | 5.0 to 20 | 5.0 to 20 |
| Protease preparation | 5.0 to 50 | 7.0 to 40 | 7.0 to 40 | 10 to 30 | 10 to 30 |
| Cumene sulfonate | 0.5 to 60 | 1.0 to 50 | 2.0 to 40 | 2.0 to 40 | 5.0 to 30 |
| 1,2-propylene glycol | 5.0 to 80 | 5.0 to 80 | 10 to 60 | 10 to 60 | 20 to 50 |
| 4-FPBA | 0 to 10 | 0 to 10 | 0 to 6 | 0 to 6 | 0 to 3.0 |

TABLE 12-continued

| | Formulation 1 | Formulation 2 | Formulation 3 | Formulation 4 | Formulation 5 |
|---|---|---|---|---|---|
| Org. calcium salt | 0 to 10 | 0 to 8 | 0 to 8 | 0 to 8 | 0 to 5 |
| Misc. | ad 100 | ad 100 | ad 100 | ad 100 | ad 100 |

TABLE 13

| | Formulation 1 | Formulation 2 | Formulation 3 | Formulation 4 | Formulation 5 |
|---|---|---|---|---|---|
| Amylase preparation | 5.0 to 30 | 5.0 to 25 | 5.0 to 25 | 5.0 to 20 | 5.0 to 20 |
| Protease preparation | 5.0 to 50 | 7.0 to 40 | 7.0 to 40 | 10 to 30 | 10 to 30 |
| Cumene sulfonate | 0.5 to 60 | 1.0 to 50 | 2.0 to 40 | 2.0 to 40 | 5.0 to 30 |
| 1,2-propylene glycol | 0 to 80 | 0 to 80 | 0 to 60 | 0 to 60 | 0 to 50 |
| 4-FPBA | 0.001 to 10 | 0.001 to 10 | 0.002 to 6 | 0.002 to 6 | 0.05 to 3.0 |
| Org. calcium salt | 0 to 10 | 0 to 8 | 0 to 8 | 0 to 8 | 0 to 5 |
| Misc. | ad 100 | ad 100 | ad 100 | ad 100 | ad 100 |

TABLE 14

| | Formulation 1 | Formulation 2 | Formulation 3 | Formulation 4 | Formulation 5 |
|---|---|---|---|---|---|
| Amylase preparation | 5.0 to 30 | 5.0 to 25 | 5.0 to 25 | 5.0 to 20 | 5.0 to 20 |
| Protease preparation | 5.0 to 50 | 7.0 to 40 | 7.0 to 40 | 10 to 30 | 10 to 30 |
| Cumene sulfonate | 0.5 to 60 | 1.0 to 50 | 2.0 to 40 | 2.0 to 40 | 5.0 to 30 |
| 1,2-propylene glycol | 0 to 80 | 0 to 80 | 0 to 60 | 0 to 60 | 0 to 50 |
| 4-FPBA | 0 to 10 | 0 to 10 | 0 to 6 | 0 to 6 | 0 to 3.0 |
| Org. calcium salt | 0.01 to 10 | 0.2 to 8 | 0.2 to 8 | 0.2 to 8 | 0.5 to 5 |
| Misc. | ad 100 | ad 100 | ad 100 | ad 100 | ad 100 |

TABLE 15

| | Formulation 1 | Formulation 2 | Formulation 3 | Formulation 4 | Formulation 5 |
|---|---|---|---|---|---|
| Amylase preparation | 5.0 to 30 | 5.0 to 25 | 5.0 to 25 | 5.0 to 20 | 5.0 to 20 |
| Protease preparation | 5.0 to 50 | 7.0 to 40 | 7.0 to 40 | 10 to 30 | 10 to 30 |
| Cumene sulfonate | 0.5 to 60 | 1.0 to 50 | 2.0 to 40 | 2.0 to 40 | 5.0 to 30 |
| 1,2-propylene glycol | 5.0 to 80 | 5.0 to 80 | 10 to 60 | 10 to 60 | 20 to 50 |
| 4-FPBA | 0.001 to 10 | 0.001 to 10 | 0.002 to 6 | 0.002 to 6 | 0.05 to 3.0 |
| Org. calcium salt | 0 to 10 | 0 to 8 | 0 to 8 | 0 to 8 | 0 to 5 |
| Misc. | ad 100 | ad 100 | ad 100 | ad 100 | ad 100 |

TABLE 16

| | Formulation 1 | Formulation 2 | Formulation 3 | Formulation 4 | Formulation 5 |
|---|---|---|---|---|---|
| Amylase preparation | 5.0 to 30 | 5.0 to 25 | 5.0 to 25 | 5.0 to 20 | 5.0 to 20 |
| Protease preparation | 5.0 to 50 | 7.0 to 40 | 7.0 to 40 | 10 to 30 | 10 to 30 |
| Cumene sulfonate | 0.5 to 60 | 1.0 to 50 | 2.0 to 40 | 2.0 to 40 | 5.0 to 30 |
| 1,2-propylene glycol | 5.0 to 80 | 5.0 to 80 | 10 to 60 | 10 to 60 | 20 to 50 |
| 4-FPBA | 0.001 to 10 | 0.001 to 10 | 0.002 to 6 | 0.002 to 6 | 0.05 to 3.0 |
| Org. calcium salt | 0.01 to 10 | 0.2 to 8 | 0.2 to 8 | 0.2 to 8 | 0.5 to 5 |
| Misc. | ad 100 | ad 100 | ad 100 | ad 100 | ad 100 |

Preferred inventive washing or cleaning agent preparations A comprise a substance from the group of the tri- or polyhydric alcohols as an additional ingredient, preferably in amounts of 0.1 to 20 wt. %, particularly preferably 0.5 to 15 wt. % and especially 1.0 to 10 wt. %.

A further preferred ingredient of the inventive washing or cleaning agent preparation A are finally the non-ionic surfactants of the general Formula $R^1$—$CH(OH)CH_2O$-$(AO)_w$-$(AO)_x$-$(A''O)_y$-$(A'''O)_z$—$R^2$, in which $R^1$ stands for a straight chain or branched, saturated or mono- or polyunsaturated $C_{6-24}$ alkyl or alkenyl group;

$R^2$ stands for a linear or branched hydrocarbon group containing 2 to 26 carbon atoms;

A, A', A'' and A''' independently of one another stand for a group from the group —$CH_2CH_2$, —$CH_2CH_2$—$CH_2$, —$CH_2$—$CH(CH_3)$, —$CH_2$—$CH_2$—$CH_2$—$CH_2$, —$CH_2$—$CH(CH_3)$—$CH_2$—, —$CH_2$—$CH(CH_2$—$CH_3)$, w, x, y and z stand for values between 0.5 and 120, wherein x, y and/or z can also be 0 are preferred.

The weight fraction of these non-ionic surfactants in preferred liquid washing or cleaning agent preparations A is 0.5 to 30 wt. %, preferably 2.0 to 25 wt. % and in particular 5.0 to 20 wt. %, relative to the total weight of the washing or cleaning agent preparations.

By adding the abovementioned non-ionic surfactants of the general formula $R^1$—$CH(OH)CH_2O$-$(AO)_w$-$(A'O)_x$-$(A''O)_y$-$(A'''O)_z$—$R^2$, hereinafter also designated as the "hydroxy mixed ethers", the cleaning power of the inventive enzyme-containing preparation can be surprisingly significantly improved, both in comparison with surfactant-free systems as well as in comparison with systems that comprise alternative non-ionic surfactants, for example from the group of the polyalkoxylated fatty alcohols.

The stability of the enzymes contained in the washing or cleaning agent preparations according to the invention can be significantly improved by using these non-ionic surfactants having one or more free hydroxyl groups on one or both terminal alkyl groups.

Such end capped polyoxyalkylated non-ionic surfactants are particularly preferred that, in accordance with the formula $R^1O[CH_2CH_2O]_xCH_2CH(OH)R^2$, possess, in addition to a group $R^1$ that stands for linear or branched, saturated or unsaturated, aliphatic or aromatic hydrocarbon groups containing 2 to 30 carbon atoms, preferably containing 4 to 22 carbon atoms, a further linear or branched, saturated or unsaturated, aliphatic or aromatic hydrocarbon group $R^2$ containing 1 to 30 carbon atoms, wherein x stands for values between 1 and 90, preferably for values between 30 and 80 and especially for values between 30 and 60.

Particularly preferred surfactants satisfy the formula $R^1O[CH_2CH(CH_3)O]_x[CH_2CH_2O]_yCH_2CH(OH)R^2$, in which $R^1$ stands for a linear or branched aliphatic hydrocarbon group containing 4 to 18 carbon atoms or mixtures thereof, $R^2$ means a linear or branched hydrocarbon group containing 2 to 26 carbon atoms or mixtures thereof and x stands for values between 0.5 and 1.5 and y stands for a value of at least 15. The group of these non-ionic surfactants includes for example the $C_{2-26}$ fatty alcohol-$(PO)_1$-$(EO)_{15-40}$-2-hydroxyalkyl ether, in particular also the $C_{8-10}$ fatty alcohol-$(PO)_1$-$(EO)_{22}$-2-hydroxydecyl ether.

Further particularly preferred are those end-capped poly (oxyalkylated) non-ionic surfactants of the formula $R^1O[CH_2CH_2O]_x[CH_2CH(R^3)O]_yCH_2CH(OH)R^2$, in which $R^1$ and $R^2$ independently of one another stand for linear or branched, saturated or mono- or polyunsaturated hydrocarbon groups containing 2 to 26 carbon atoms, $R^3$ independently of one other is selected from —$CH_3$, —$CH_2CH_3$, —$CH_2CH_2$—$CH_3$, —$CH(CH_3)_2$, preferably however —$CH_3$, and x and y independently of one another stand for values between 1 and 32, wherein surfactants with $R^3$=—$CH_3$ and values for x of 15 to 32 and y of 0.5 and 1.5 are quite particularly preferred.

Further preferred suitable non-ionic surfactants are the end-blocked poly(oxyalkylated) non-ionic surfactants of the formula $R^1O[CH_2CH(R^3)O]_x[CH_2]_kCH(OH)[CH_2]_jOR^2$, in which $R^1$ and $R^2$ stand for linear or branched, saturated or unsaturated, aliphatic or aromatic hydrocarbon groups containing 1 to 30 carbon atoms, $R^3$ stands for H or for a methyl, ethyl, n-propyl, isopropyl, n-butyl, 2-butyl or 2-methyl-2-butyl group, x for values between 1 and 30, k and j have values between 1 and 12, preferably between 1 and 5. Each $R^3$ in the above formula $R^1O[CH_2CH(R^3)O]_x[CH_2]_kCH(OH)[CH_2]_jOR^2$ can be different for the case where $x \geqq 2$. $R^1$ and $R^2$ are preferably linear or branched, saturated or unsaturated, aliphatic or aromatic hydrocarbon groups containing 6 to 22 carbon atoms, groups containing 8 to 18 carbon atoms being particularly preferred. H, —$CH_3$ or —$CH_2CH_3$ are particularly preferred for the group $R^3$. Particularly preferred values for x are in the range from 1 to 20 and more particularly in the range from 6 to 15.

As described above, each $R^3$ in the above formula can be different for the case where $x \geqq 2$. By this means, the alkylene oxide unit in the straight brackets can be varied. If, for example, x has a value of 3, then the substituent $R^3$ may be selected to form ethylene oxide ($R^3$=H) or propylene oxide ($R^3$=$CH_3$) units which may be joined together in any order, for example (EO)(PO)(EO), (EO)(EO)(PO), (EO)(EO)(EO), (PO)(EO)(PO), (PO)(PO)(EO) and (PO)(PO)(PO). The value 3 for x was selected by way of example and may easily be larger, the range of variation increasing with increasing x-values and including, for example, a large number of (EO) groups combined with a small number of (PO) groups or vice versa.

Particularly preferred end-capped poly(oxyalkylated) alcohols corresponding to the above formula have values of k=1 and j=1, so that the above formula can be simplified to $R^1O[CH_2CH(R^3)O]_xCH_2CH(OH)CH_2OR^2$. In this last formula, $R^1$, $R^2$ and $R^3$ are as defined above and x stands for numbers from 1 to 30, preferably 1 to 20 and especially 6 to 18. Surfactants in which the substituents R and $R^2$ have 9 to 14 carbon atoms, $R^3$ stands for H and x assumes values of 6 to 15 are particularly preferred.

Finally, the non-ionic surfactants of the following general formula $R^1$—$CH(OH)CH_2O$-$(AO)_w$—$R^2$ have proved to be particularly effective, in which

- $R^1$ stands for a straight chain or branched, saturated or mono- or polyunsaturated $C_{6-24}$ alkyl or alkenyl group;
- $R^2$ stands for a linear or branched hydrocarbon group containing 2 to 26 carbon atoms;
- A stands for a group from the group $CH_2CH_2$, —$CH_2CH_2$—$CH_2$, —$CH_2$—$CH(CH_3)$, and
- w stands for values between 1 and 120, preferably 10 to 80, particularly 20 to 40

The group of these non-ionic surfactants includes for example the $C_{4-22}$ fatty alcohol-$(PO)_{10-80}$-2-hydroxyalkyl ethers, in particular also the $C_{8-12}$ fatty alcohol-$(EO)_{22}$-2-hydroxydecyl ethers and the $C_{4-22}$ fatty alcohol-$(EO)_{40-80}$-2-hydroxyalkyl ethers.

In addition to the above described ingredients, such as enzymes, solvents and non-ionic surfactants from the group of the hydroxy mixed ethers, the washing or cleaning agent preparations A according to the invention can comprise further ingredients, for example active substances from the group of the builders, the bleaching agents, the active washing and cleaning polymers, the corrosion inhibitors, the fragrances or colorants. Contrary to customary washing or cleaning agents, preferred washing or cleaning agent preparations A according to the invention comprise these further ingredients, however, only in minor amounts.

In particular, those washing or cleaning agent preparations A that comprise less than 20 wt. %, preferably less than 10 wt. % and especially less than 5 wt. % builders, are inventively preferred. In particular, those washing or cleaning agent preparations A that are free of builders, are particularly preferred.

In addition, those washing or cleaning agent preparations A that comprise less than 10 wt. %, preferably less than 5 wt. % and especially less than 2 wt. % bleaching agent, are preferred. In particular, those washing or cleaning agent preparations A that are free of bleaching agents, are particularly preferred.

Even when the abovementioned additional detersive ingredients are preferably comprised in only minor amounts in the washing or cleaning agent preparations A according to the invention, i.e. are directly blended with them, then it is nevertheless desirable to make up these additional ingredients together with the preparations according to the invention into a washing or cleaning agent. In this respect the person skilled in the art can draw on all known manufactured types of combined products containing a liquid fraction, wherein those combined products that have proven to be particularly suitable enable the common fabrication of two, three, four or more mutually separate liquid preparations.

The washing or cleaning agent preparations A according to the invention are characterized by a low formulation complexity in spite of their high physical and chemical stability. This low degree of complexity simplifies the manufacture of the cleaning agent and consequently lowers the costs associated with the production of this cleaning agent. For this reason, preferred cleaning agents according to the invention are characterized in that they include, besides the key ingredients a), b), c) and d), at most three, preferably at most two, particularly preferably at most one and especially no further ingredients. The content by weight of further ingredients is advantageously less than 10 wt. %, preferably less than 5 wt. %, particularly preferably less than 2 wt. % and quite particularly preferably less than 0.1 wt. %.

In another embodiment, the cleaning agents according to the invention are combined with one or more additional cleaning agents. A cleaning agent combination, comprising a) a washing or cleaning agent preparation A according to the invention;

b) at least one, preferably at least two additional washing or cleaning agent preparations that are different from A is a further subject matter of the present invention.

The additional cleaning agents that are combined with the cleaning agent according to the invention preferably concern cleaning agents comprising surfactant and/or builder.

Preferred liquid preparations are those wherein they are made up together with one, preferably two or three additional liquid washing or cleaning agent preparations into a combined product. The additional one, two or three liquid washing or cleaning agent preparations in this case have a different composition from the enzyme-containing washing or cleaning agent preparation according to the invention. The additional one, two or three liquid washing or cleaning agent preparations are preferably free of bleaching agent and/or phosphate.

In addition to the described surfactants and enzymes, the additional liquid washing or cleaning agent preparations can comprise additional detersive substances, wherein substances from the group of the builders, polymers, glass corrosion inhibitors, corrosion inhibitors, fragrances and perfume carriers are preferred.

In addition, bleaching agents and bleach activators can also be added. These preferred ingredients are more closely described below.

The builders include in particular the zeolites, silicates, carbonates and organic cobuilders.

Crystalline layer-forming silicate of the general formula $NaMSi_xO_{2x+1}$ y $H_2O$ are preferably employed, wherein M represents sodium or hydrogen, x is a number from 1.9 to 22, preferably 1.9 to 4, wherein particularly preferred values for x are 2, 3 or 4 and y stands for a number from 0 to 33, preferably from 0 to 20.

Crystalline, layered silicates of formula $NaMSi_xO_{2x+1}$ y $H_2O$, in which x stands for 2, are particularly suitable for the purposes of the present invention. Both β- and also δ-sodium disilicates $Na_2Si_2O_5$.y $H_2O$ as well as additionally most notably Na-SKS-5 (α-$Na_2Si_2O_5$), Na-SKS-7 (β-$Na_2Si_2O_5$, Natrosilit), Na-SKS-9 ($NaHSi_2O_5.H_2O$), Na-SKS-10 ($NaHSi_2O_5.3H_2O$, Kanemit), Na-SKS-11 (t-$Na_2Si_2O_5$) and Na-SKS-13 ($NaHSi_2O_5$) are preferred but Na-SKS-6 (δ-$Na_2Si_2O_5$) is particularly preferred.

Washing or cleaning agents preferably comprise a content by weight of crystalline layered silicates of formula $NaMSi_xO_{2x+1}$.y $H_2O$ of 0.1 to 20 wt. %, preferably 0.2 to 15 wt. % and particularly 0.4 to 10 wt. %, each based on the total weight of the agent.

Other useful builders are amorphous sodium silicates with a modulus ($Na_2O:SiO_2$ ratio) of 1:2 to 1:3.3, preferably 1:2 to 1:2.8 and more preferably 1:2 to 1:2.6, which preferably dissolve with a delay and exhibit secondary wash cycle properties. Further builders are the alkalinity sources. Alkali metal hydroxides, alkali metal carbonates, alkali metal hydrogen carbonates, alkali metal sesquicarbonates, the cited alkali silicates, alkali metal silicates and mixtures of the cited materials can be used as alkaline entities, where in the context of this invention, the alkali carbonates are preferably used, especially sodium carbonate, sodium hydrogen carbonate or sodium sesquicarbonate. A builder system comprising a mixture of tripolyphosphate and sodium carbonate is particularly preferred. A builder system comprising a mixture of tripolyphosphate and sodium carbonate and sodium disilicate is also particularly preferred. Because of their low chemical compatibility—in comparison with other builders—with the usual ingredients of washing agents and cleaning compositions, the alkali metal hydroxides are preferably only incorporated in low amounts, advantageously in amounts below 10 wt. %, preferably below 6 wt. %, particularly preferably below 4 wt. % and particularly below 2 wt. %, each based on the total weight of the washing or cleaning agent. Compositions that comprise less than 0.5 wt. %, based on their total weight, and in particular no alkali metal hydroxide, are particularly preferred.

Organic co builders include, in particular, polycarboxylates/polycarboxylic acids, polymeric polycarboxylates, aspartic acid, polyacetals, dextrins, other organic co builders and phosphonates. These classes of substances are described below.

Useful organic builders are, for example, the polycarboxylic acids that can be used in the form of the free acid and/or their sodium salts, polycarboxylic acids in this context being understood to be carboxylic acids that carry more than one acid function. These include, for example, citric acid, adipic acid, succinic acid, glutaric acid, malic acid, tartaric acid, maleic acid, fumaric acid, sugar acids, amino carboxylic acids, nitrilotriacetic acid (NTA), providing such use is not ecologically unsafe, and mixtures thereof. Besides their building effect, the free acids also typically have the property of an acidifying component and hence also serve to establish a relatively low and mild pH of washing or cleaning agents. Citric acid, succinic acid, glutaric acid, adipic acid, gluconic acid and any mixtures thereof are particularly mentioned in this regard.

Other suitable builders are additionally polymeric polycarboxylates, for example the alkali metal salts of polyacrylic or polymethacrylic acid, for example those with a relative molecular weight of 500 to 70 000 g/mol.

The molecular weights mentioned in this specification for polymeric polycarboxylates are weight-average molecular weights $M_w$ of the particular acid form which, fundamentally, were determined by gel permeation chromatography (GPC), equipped with a UV detector. The measurement was carried out against an external polyacrylic acid standard, which provides realistic molecular weight values by virtue of its structural similarity to the polymers investigated. These values differ significantly from the molecular weights measured against polystyrene sulfonic acids as the standard. The molecular weights measured against polystyrene sulfonic acids are generally significantly higher than the molecular weights mentioned in this specification.

Particularly suitable polymers are polyacrylates, which preferably have a molecular weight of 2 000 to 20 000 g/mol. By virtue of their superior solubility, preferred representatives of this group are again the short-chain polyacrylates, which have molecular weights of 2 000 to 10 000 g/mol and, more particularly, 3 000 to 5 000 g/mol.

Further suitable copolymeric polycarboxylates are particularly those of acrylic acid with methacrylic acid and of acrylic acid or methacrylic acid with maleic acid. Copolymers of acrylic acid with maleic acid, which comprise 50 to 90 wt. % acrylic acid and 50 to 10 wt. % maleic acid, have proven to be particularly suitable. Their relative molecular weight, based on free acids, generally ranges from 2 000 to 70 000 g/mol, preferably 20 000 to 50 000 g/mol and especially 30 000 to 40 000 g/mol.

In order to improve the water solubility, the polymers can also comprise allyl sulfonic acids, such as for example, allyloxybenzene sulfonic acid and methallyl sulfonic acid as monomers.

Particular preference is also given to biodegradable polymers comprising more than two different monomer units, examples being those comprising, as monomers, salts of acrylic acid and of maleic acid, and also vinyl alcohol or vinyl alcohol derivatives, or those comprising, as monomers, salts of acrylic acid and of 2-alkylallylsulfonic acid, and also sugar derivatives.

Other preferred copolymers are those which preferably contain acrolein and acrylic acid/acrylic acid salts or acrolein and vinyl acetate as monomers.

Exemplary polymers active for water softening are polymers with sulfonic acid groups, which are especially preferably employed.

Particularly preferred suitable polymers comprising sulfonic acid groups are copolymers of unsaturated carboxylic acids, monomers comprising sulfonic acid groups and optional further ionic or non-ionogenic monomers.

In the context of the present invention, unsaturated carboxylic acids of the formula $$R^1(R^2)C{=}C(R^3)COOH$$

are preferred monomers, in which $R^1$ to $R^3$ independently of one another stand for —H, —$CH_3$, a linear or branched, saturated alkyl group containing 2 to 12 carbon atoms, a linear or branched, mono- or polyunsaturated alkenyl group containing 2 to 12 carbon atoms, with —$NH_2$, —OH or —COOH substituted alkyl or alkenyl groups or for —COOH or —$COOR^4$, wherein $R^4$ is a saturated or unsaturated, linear or branched hydrocarbon group containing 1 to 12 carbon atoms.

Among the unsaturated carboxylic acids corresponding to the above formula, acrylic acid ($R^1{=}R^2{=}R^3{=}H$), methacrylic acid ($R^1{=}R^2{=}H$; $R^3{=}CH_3$) and/or maleic acid ($R^1{=}COOH$; $R^2{=}R^3{=}H$) are particularly preferred .

The preferred monomers containing sulfonic acid groups are those of the formula, $$R^5(R^6)C{=}C(R^7)—X—SO_3H$$

in which $R^5$ to $R^7$ independently of one another stand for —H, —$CH_3$, a linear or branched, saturated alkyl group containing 2 to 12 carbon atoms, a linear or branched, mono- or polyunsaturated alkenyl group containing 2 to 12 carbon atoms, with —$NH_2$, —OH or —COOH substituted alkyl or alkenyl groups or —COOH or —$COOR^4$, wherein $R^4$ is a saturated or unsaturated, linear or branched hydrocarbon group containing 1 to 12 carbon atoms, and X stands for an optionally present spacer group that is selected from —$(CH_2)_n$— with n=0 to 4, —COO—$(CH_2)_k$— with k=1 to 6, —C(O)—NH—$C(CH_3)_2$—, —C(O)—NH—$C(CH_3)_2CH_2$— and —C(O)—NH—$CH(CH_2CH_3)$—.

Among these monomers those are preferred of the formulas $$H_2C{=}CH—X—SO_3H$$

$$H_2C{=}C(CH_3)—X—SO_3H$$

$$HO_3S—X—(R^6)C{=}C(R^7)—X—SO_3H,$$

in which $R^6$ and $R^7$ independently of one another are selected from —H, —$CH_3$, —$CH_2CH_3$, —$CH_2CH_2CH_3$, —$CH(CH_3)_2$ and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—$CH(CH_2CH_3)$—.

Accordingly, particularly preferred sulfonic acid-containing monomers are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxy-propanesulfonic acid, allylsulfonic acid, methallylsulfonic acid, allyloxybenzenesulfonic acid, methallyloxybenzenesulfonic acid, 2-hydroxy-3-(2-propenyloxy) propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethylacrylamide, sulfomethylmethacrylamide and water-soluble salts of the cited acids.

Additional ionic or non-ionic monomers particularly include ethylenically unsaturated compounds. Preferably, the content of these additional ionic or non-ionic monomers in the added polymers is less than 20 wt. %, based on the polymer. Particularly preferred polymers for use consist solely of monomers of the formula $R^1(R^2)C{=}C(R^3)COOH$ and monomers of the formula $R^5(R^6)C{=}C(R^7)—X—SO_3H$.

The sulfonic acid groups may be present in the polymers completely or partly in neutralized form, i.e. the acidic hydrogen atom of the sulfonic acid groups can be replaced by metal ions, preferably alkali metal ions and more particularly sodium ions, in some or all of the sulfonic acid groups. The addition of copolymers containing partly or fully neutralized sulfonic acid groups is preferred according to the invention.

The monomer distribution of the inventively preferred copolymers used ranges for copolymers that comprise only monomers defined in groups (i) and (ii) from preferably 5 to 95 wt. % (i) and (ii) respectively, particularly preferably 50 to 90 wt. % monomer from group (i) and 10 to 50 wt. % monomer from group (ii) respectively, based on the polymer.

Particularly preferred terpolymers are those that comprise 20 to 85 wt. % monomer from group (i), 10 to 60 wt. % monomer from group (ii) and 5 to 30 wt. % monomer from group (iii).

The molecular weight of the inventively preferred sulfocopolymers used can be varied to adapt the properties of the polymer to the desired application requirement. Preferred washing or cleaning compositions are those wherein the molecular weights of the copolymers are 2 000 to 200 000 $gmol^{-1}$, preferably 4 000 to 25 000 $gmol^{-1}$ and especially 5 000 to 15 000 $gmol^{-1}$.

In a further preferred embodiment, the inventive washing or cleaning agent preparations comprise a hydrophobically modified copolymer d). Surprisingly, the cleaning power of the enzymes, particularly the proteases, could be further improved by the addition of hydrophobically modified copolymers.

Particularly preferred hydrophobically modified copolymers contain i) monomers from the group of the mono- or polyunsaturated carboxylic acids ii) monomers of the general formula $R^1(R^2)C{=}C(R^3)—X—R^4$, in which $R^1$ to $R^3$ independently of one another stands for —H, —$CH_3$ or —$C_2H_5$, X stands for an optionally present spacer group selected from —$CH_2$—, —C(O)O— and —C(O)—NH—, and $R^4$ stands for a straight chain or branched saturated alkyl group containing 2 to 22 carbon atoms or for an unsaturated, preferably aromatic group containing 6 to 22 carbon atoms iii) optional further monomers.

Particularly preferred copolymers d) comprise as the carboxyl group-containing monomers i) acrylic acid, methacrylic acid, ethacrylic acid, α-chloroacrylic acid, α-cyanoacrylic acid, crotonic acid, α-phenylacrylic acid, maleic acid, maleic anhydride, fumaric acid, itaconic acid, citraconic acid, methylenemalonic acid, sorbic acid, cinnamic acid or their mixtures.

Particularly preferred copolymers d) comprise monomers of the general formula $R^1(R^2)C{=}C(R^3)—X—R^4$ as the added non-ionic monomers ii). Particularly preferred monomers of this type are butene, isobutene, pentene, 3-methylbutene, 2-methylbutene, cyclopentene, hexene, 1-hexene, 2-methylpentene-1,3-methylpentene-1, cyclohexene, methylcyclopentene, cycloheptene, methylcyclohexene, 2,4,4-trimethylpentene-1,2,4,4-trimethylpentene-2,2,3-dimethylhexene-1,2,4-dimethylhexene-1,2,5-dimethylhexene-1,3,5-dimethylhexene-1,4,4-dimethylhexene-1, ethylcyclohexyne, 1-octene, α-olefins containing 10 or more carbon atoms such as for example 1-decene, 1-dodecene, 1-hexadecene, 1-octadecene and C22-α-olefin, 2-styrene, α-methylstyrene, 3-methylstyrene, 4-propylstyrene, 4-cyclohexylstyrene, 4-dodecylstyrene, 2-ethyl-4-benzylstyrene, 1-vinylnaphthalene, 2-vinylnaphthalene, methyl acrylate, ethyl acrylate, propyl acrylate, butyl acrylate, pentyl acrylate, hexyl acrylate, methyl methacrylate, N-(methyl)acrylamide, 2-ethylhexyl acrylate, 2-ethylhexyl methacrylate, N-(2-ethylhexyl)acrylamide, octyl acrylate, octyl methacrylate, N-(octyl)acrylamide, lauryl acrylate, lauryl methacrylate, N-(lauryl)acrylamide, stearyl acrylate, stearyl methacrylate, N-(stearyl) acrylamide, behenyl acrylate, behenyl methacrylate and N-(behenyl)acrylamide or their mixtures.

Similarly, other preferred builders are polymeric amino dicarboxylic acids, salts or precursors thereof. Polyaspartic acids or their salts are particularly preferred.

Oxydisuccinates and other derivatives of disuccinates, preferably ethylenediamine disuccinate are also further suitable cobuilders. Ethylenediamine-N,N'-disuccinate (EDDS) is preferably used here in the form of its sodium or magnesium salts. In this context, glycerin disuccinates and glycerin trisuceinates are also preferred. Suitable addition quantities are from 3 to 15 wt. %.

The automatic dishwashing agents according to the invention particularly preferably comprise methyl glycine diacetic acid or a salt of methyl glycine diacetic acid.

Other useful organic co-builders are, for example, acetylated hydroxycarboxylic acids and salts thereof, which optionally may also be present in lactone form and which contain at least 4 carbon atoms, at least one hydroxyl group and at most two acid groups.

In addition, any compounds capable of forming complexes with alkaline earth metal ions may be used as co-builders.

Glass corrosion inhibitors prevent the occurrence of smears, streaks and scratches as well as iridescence on the surfaces of glasses washed in an automatic dishwasher. Preferred glass corrosion inhibitors come from the group of the magnesium salts and zinc salts and magnesium complexes and zinc complexes.

The spectrum of the inventively preferred zinc salts, advantageously of organic acids, particularly preferably of organic carboxylic acids, ranges from salts that are difficulty soluble or insoluble in water, i.e. with a solubility below 100 mg/l, preferably below 10 mg/l, or especially below 0.01 mg/l, to such salts with solubilities in water greater than 100 mg/l, preferably over 500 mg/l, particularly preferably over 1 g/l and especially over 5 g/l (all solubilities at a water temperature of 20° C.). The first group of zinc salts includes for example zinc citrate, zinc oleate and zinc stearate, the group of soluble zinc salts includes for example zinc formate, zinc acetate, zinc lactate and zinc gluconate.

A particular advantageous glass corrosion inhibitor employs at least one zinc salt of an organic carboxylic acid, particularly preferably a zinc salt from the group zinc stearate, zinc oleate, zinc gluconate, zinc acetate, zinc lactate and/or zinc citrate. Zinc ricinoleate, zinc abietate and zinc oxalate are also preferred.

Corrosion inhibitors serve to protect the tableware or the machine, silver protection agents being particularly important in automatic dishwashing. Substances known from the prior art can be incorporated. Above all, silver protectors selected from the group of the triazoles, the benzotriazoles, the bis-benzotriazoles, the aminotriazoles, the alkylaminotriazoles and the transition metal salts or transition metal complexes may generally be used. Benzotriazole and/or alkylaminotriazole are particularly preferably used. The use of 3-amino-5-alkyl-1,2,4-triazoles or their physiologically compatible salts is inventively preferred. Preferred acids for the salt formation are hydrochloric acid, sulfuric acid, phosphoric acid, carbonic acid, sulfurous acid, organic carboxylic acids like acetic acid, glycolic acid, citric acid and succinic acid. 5-Pentyl-, 5-heptyl-, 5-nonyl-, 5-undecyl-, 5-isononyl-, 5-versatic-10-acid alkyl-3-amino-1,2,4-triazoles as well as mixtures of these substances are quite particularly efficient.

In the context of the present invention, suitable perfume oils or fragrances include individual odoriferous compounds, for example synthetic products of the ester, ether, aldehyde, ketone, alcohol and hydrocarbon type. However, mixtures of various odoriferous substances, which together produce an attractive fragrant note, are preferably used. Perfume oils such as these may also contain natural odoriferous mixtures obtainable from vegetal sources, for example pine, citrus, jasmine, patchouli, rose or ylang-ylang oil.

Preferred colorants, which are not difficult for the person skilled in the art to choose, have a high storage stability, are not affected by the other ingredients of the agent or by light and do not have any pronounced substantivity for the substrates such as glass, ceramics or plastic dishes being treated with the colorant-containing agent, so as not to color them.

Another subject matter of this application is a process for washing table ware in an automatic dishwasher or for washing fabrics in a washing machine by using a liquid washing or cleaning agent preparation, containing a) at least one active washing or cleaning enzyme;

b) 1,2-propylene glycol c) non-ionic surfactant of the general formula $R^1$—CH(OH)$CH_2O$-$(AO)_w$-$(A'O)_x$-$(A''O)_y$-$(A'''O)_z$—$R^2$, in which $R^1$ stands for a straight chain or branched, saturated or mono- or polyunsaturated $C_{6-24}$ alkyl or alkenyl group;

$R^2$ stands for a linear or branched hydrocarbon group containing 2 to 26 carbon atoms;

A, A', A'' and A''' independently of one another stand for a group from the group —$CH_2CH_2$, —$CH_2CH_2$—$CH_2$, —$CH_2$—$CH(CH_3)$, —$CH_2$—$CH_2$—$CH_2$—$CH_2$, —$CH_2$—$CH(CH_3)$—$CH_2$—, —$CH_2$—$CH(CH_2$—$CH_3)$, w, x, y and z stand for values between 0.5 and 120, wherein x, y and/or z can also be 0.

The washing or cleaning agent preparations according to the invention which are particularly preferably employed in these processes correspond to the compositions described above in detail. In order to avoid repetition here, reference is made to the above embodiments.

Preferred processes for cleaning table ware or washing fabrics are those wherein the liquid washing or cleaning agent preparation is metered into the interior of the automatic dishwasher or washing machine from a storage reservoir that is located in the automatic dishwasher and which comprises multiple amounts of the washing or cleaning agent preparation needed for carrying out a cleaning process.

As explained in the introduction, the storage reservoir used for the metering can be a storage reservoir that is integrated into the automatic dishwasher or washing machine, i.e. a storage reservoir that is permanently fixed (built in) to the automatic dishwasher or washing machine, but can also be an autarkic, i.e. an independent storage reservoir that can be inserted into the interior of the automatic dishwasher or washing machine.

An example of an integrated storage reservoir is a receptacle that is integrated into the door of the automatic dishwasher and is connected to the interior of the automatic dishwasher over a supply line.

An example of an autarkic storage reservoir is a so-called "top-down bottle" with a base outlet valve and which can be placed for example in the cutlery basket of the automatic dishwasher.

The storage reservoir possesses at least one chamber for receiving the liquid washing or cleaning agent preparation according to the invention. In a preferred embodiment, the storage reservoir disposes of more than one, preferably two, three, four or more separate chambers that are separated from each other, of which at least one chamber contains the liquid washing or cleaning agent preparations according to the invention, whereas at least one, preferably at least two additional chambers, contain(s) preferably liquid preparations with a composition that differs from those of the liquid washing or cleaning agent preparations according to the invention.

In particular, those processes according to the invention are particularly preferred which use a storage reservoir having two separate chambers that are separated from one another, of which one chamber comprises a liquid washing or cleaning agent preparation according to the invention, whereas the second chamber comprises a likewise liquid, bleaching agent-free preparation of differing composition.

In preferred cleaning processes a quantity of between 1.0 and 15 ml, preferably between 2.0 and 12 ml and especially between 4.0 and 10 ml of the liquid washing or cleaning agent preparation according to the invention, is metered per wash cycle into the interior of the automatic dishwasher.

The volume of the preferred storage reservoirs with one or more chambers is between 10 and 1000 ml, preferably between 20 and 800 ml and especially between 50 and 500 ml.

As explained above, the washing or cleaning agent preparations according to the invention are characterized by a particular temperature stability and are employed in the process according to the invention in particular for repeated metering of these preparations from the storage reservoirs located in the interior of the automatic dishwasher or washing machine. Preferred processes according to the invention are those wherein the liquid washing or cleaning agent preparation A, prior to being metered into the interior of the automatic dishwasher or washing machine, remains in the storage reservoir that is located in the automatic dishwasher for at least two, preferably at least four, particularly preferably at least eight and in particular at least twelve separate cleaning processes.

In the context of the present application, "separate cleaning processes" are called completed cleaning processes that preferably also include a pre rinse cycle and/or a final rinse cycle in addition to the main cleaning cycle and which can be selected and actuated by means of the program switch of the automatic dishwasher. The duration of these separate cleaning processes is advantageously at least 15 minutes, advantageously between 20 and 360 minutes, preferably between 30 and 240 minutes.

The length of time between two separate cleaning processes, within which the liquid washing or cleaning agent preparation is metered into the interior of the automatic dishwasher, is at least 20 minutes, preferably at least 60 minutes, particularly preferably at least 120 minutes.

The exposure to high temperatures of the liquid washing or cleaning agent preparations according to the invention can vary widely in the course of the processes according to the invention, wherein the liquid washing or cleaning agent preparations are particularly suitable for those processes, in which the liquid washing or cleaning agent preparation A in the storage reservoir is heated at least two times, preferably at least four times, particularly preferably at least eight times and in particular at least twelve times to temperatures above 30° C., preferably above 40° C. and particularly preferably above 50° C. Naturally, heating the liquid washing or cleaning agent preparation A to temperatures above 60° C. or 70° C. or heating it twenty or thirty times can also be realized according to the invention.

In other words, the liquid washing or cleaning agent preparation A in the storage reservoir is heated by the wash liquor surrounding this storage reservoir in each of the sequential separate cleaning processes. In preferred processes, the liquid washing or cleaning agent preparation A cools down in the storage reservoir between the separate cleaning processes to temperatures below 30° C., preferably below 26° C. and especially below 22° C.

The use of cumene sulfonate for stabilizing active washing or cleaning enzyme preparations in liquid washing or cleaning agent preparations is another subject matter of the present application.

The above described combination of cleaning agents is made up in the form of receiving chambers that are separated from one another, wherein each of these receiving chambers comprises one of the combined cleaning agents. Examples of such made-up forms are cartridges with two, three, four or more separate receiving chambers, for example two, three, four or multi-chamber bottles. Unwanted reactions due to chemical incompatibility can be excluded by separating the cleaning agents of different composition.

A subject matter of the present application is furthermore a cleaning agent presentation form, comprising a) an inventive washing or cleaning agent preparation A in a sufficient amount for carrying out at least two, preferably at least four and in particular at least eight automatic dishwasher processes or automatic fabric washing processes;

b) a cartridge for the washing or cleaning agent preparation A.

A further subject matter of the present application is a cleaning agent presentation form, comprising a) an inventive washing or cleaning agent preparation in a sufficient amount for carrying out at least two, preferably at least four and in particular at least eight automatic dishwasher processes or automatic fabric washing processes;

b) at least one additional washing or cleaning agent preparation B that differs from A in a sufficient amount for carrying out at least two, preferably at least four and in particular at least eight automatic dishwasher processes or automatic fabric washing processes;

c) a cartridge for the washing or cleaning agent preparations A and B, in which said washing or cleaning agent preparations A and B are in separate receiving chambers.

Also claimed is a cleaning agent presentation form, comprising a) an inventive washing or cleaning agent preparation A in a sufficient amount for carrying out at least two, preferably at least four and in particular at least eight automatic dishwasher processes or automatic fabric washing processes;

b) at least one additional washing or cleaning agent preparation B that differs from A in a sufficient amount for carrying out at least two, preferably at least four and in particular at least eight automatic dishwasher processes or automatic fabric washing processes;

c) at least one additional washing or cleaning agent preparation C that differs from A and B in a sufficient amount for carrying out at least two, preferably at least four and in particular at least eight automatic dishwasher processes or automatic fabric washing processes;

d) a cartridge for the washing or cleaning agent preparations A, B and C, in which said washing or cleaning agent preparations A, B and C are in separate receiving chambers.

Another subject matter of the present application is a cleaning agent dosing system, comprising a) an inventive washing or cleaning agent preparation A in a sufficient amount for carrying out at least two, preferably at least four and in particular at least eight automatic dishwasher processes or automatic fabric washing processes;

b) a cartridge for the washing or cleaning agent preparation A;

c) a dosing unit that is connected or connectable to the cartridge.

In a preferred embodiment, the previously described cartridges of the cleaning agent presentation form are provided with a dosing device that can be detached from the cartridge. A dosing device of this type can be connected to the cartridge by means of, for example, an adhesive bond, a latch connection, a snap-in connection or a push-fit connection. The cartridge is more easily filled up for example by separating the cartridge from the dosing device. Alternatively, the detachable connection of the cartridge from the dosing device enables the cartridges to be exchanged on the dosing device. Such an exchange can be displayed for example when the cleaning process is changed or when the cartridge has been completely emptied.

Another subject matter of the present application is a cleaning agent dosing system, comprising a) an inventive washing or cleaning agent preparation A in a sufficient amount for carrying out at least two, preferably at least four and in particular at least eight automatic dishwasher processes or automatic fabric washing processes;

b) a cartridge for the washing or cleaning agent preparation A;

c) a dosing unit that is releasably connected to the cartridge.

Another subject matter of the present application is a cleaning agent dosing system, comprising a) an inventive washing or cleaning agent preparation A in a sufficient amount for carrying out at least two, preferably at least four and in particular at least eight automatic dishwasher processes or automatic fabric washing processes;

b) at least one additional washing or cleaning agent preparation B that differs from A in a sufficient amount for carrying out at least two, preferably at least four and in particular at least eight automatic dishwasher processes or automatic fabric washing processes;

c) a cartridge for the washing or cleaning agent preparations A and B, in which said washing or cleaning agent preparations A and B are in separate receiving chambers;

d) a dosing unit that is releasably connected to the cartridge.

A particularly preferred subject matter of this application is a cleaning agent dosing system, comprising a) an inventive washing or cleaning agent preparation A in a sufficient amount for carrying out at least two, preferably at least four and in particular at least eight automatic dishwasher processes or automatic fabric washing processes;

b) at least one additional washing or cleaning agent preparation B that differs from A in a sufficient amount for carrying out at least two, preferably at least four and in particular at least eight automatic dishwasher processes or automatic fabric washing processes;

c) at least one additional washing or cleaning agent preparation C that differs from A and B in a sufficient amount for carrying out at least two, preferably at least four and in particular at least eight automatic dishwasher processes or automatic fabric washing processes;

d) a cartridge for the washing or cleaning agent preparations A, B and C, in which said washing or cleaning agent preparations A, B and C are in separate receiving chambers;

e) a dosing unit that is releasably connected to the cartridge.

Cleaning agent presentation forms are of course also conceivable, in which the cartridge and the dosing device are un-releasably connected with one another.

Another subject matter of the present application is a cleaning agent dosing system, comprising a) an inventive washing or cleaning agent preparation A in a sufficient amount for carrying out at least two, preferably at least four and in particular at least eight automatic dishwasher processes or automatic fabric washing processes;

b) a cartridge for the washing or cleaning agent preparation A;

c) a dosing unit that is un-releasably connected to the cartridge.

Another subject matter of the present application is a cleaning agent dosing system, comprising a) an inventive washing or cleaning agent preparation A in a sufficient amount for carrying out at least two, preferably at least four and in particular at least eight automatic dishwasher processes or automatic fabric washing processes;

b) at least one additional washing or cleaning agent preparation B that differs from A in a sufficient amount for carrying out at least two, preferably at least four and in particular at least eight automatic dishwasher processes or automatic fabric washing processes;

c) a cartridge for the washing or cleaning agent preparations A and B, in which said washing or cleaning agent preparations A and B are in separate receiving chambers;

d) a dosing unit that is un-releasably connected to the cartridge.

A particularly preferred subject matter of this application is a cleaning agent dosing system, comprising a) an inventive washing or cleaning agent preparation A in a sufficient amount for carrying out at least two, preferably at least four and in particular at least eight automatic dishwasher processes or automatic fabric washing processes;

b) at least one additional washing or cleaning agent preparation B that differs from A in a sufficient amount for carrying out at least two, preferably at least four and in particular at least eight automatic dishwasher processes or automatic fabric washing processes;

c) at least one additional washing or cleaning agent preparation C that differs from A and B in a sufficient amount for carrying out at least two, preferably at least four and in particular at least eight automatic dishwasher processes or automatic fabric washing processes;

d) a cartridge for the washing or cleaning agent preparations A, B and C, in which said washing or cleaning agent preparations A, B and C are in separate receiving chambers;

e) a dosing unit that is un-releasably connected to the cartridge.

In a preferred embodiment, the abovementioned cleaning agent dosing systems, comprising an inventive cleaning agent (as well as optionally one or two additional cleaning agents that differ from the inventive cleaning agent), a cartridge and a dosing device that is releasably connected with the cartridge, are presented in a common packaging unit, wherein the filled cartridge and the dosing device are particularly preferably comprised separately in the packaging unit. The packaging unit is used for the storage, transport and the presentation of the inventive cleaning agent presentation form and protects it from stains, shocks and knocks. The packaging unit should be designed to be at least partially transparent, in particular for the purposes of presentation.

Alternatively or in addition to a packaging unit, the possibility naturally exists to commercialize the inventive cleaning agent, cleaning agent combination or cleaning agent presentation forms together with an automatic dishwasher. A combination of this type is particularly advantageous in those cases, in which the cycle of the automatic dishwasher process (e.g. duration, temperature cycle, water supply) and the cleaning agent formulation or the control electronics of the dosing device are coordinated with each other.

The inventive dosing system consists of the basic components of a cartridge filled with the inventive cleaning agent, and a dosing device that is connectable with the cartridge, said dosing device being again formed from additional groups of components, such as for example component support, actuator, closing element, sensor, energy source and/or control unit.

The inventive dosing system is preferably movable. In the context of this application, "movable" means that the dosing system is not non-detachably connected with a water-conducting device such as for example an automatic dishwasher, washing machine, washer dryer or the like, but rather can be removed for example from an automatic dishwasher by the consumer or can be placed in an automatic dishwasher, i.e. it is independently manageable.

According to an alternative development of the invention, it is also conceivable that the dosing device for the consumer is not releasably connected with a water-conducting device, such as for example an automatic dishwasher, washing machine, washer dryer or the like and only the cartridge can be moved.

As the pH of the preparations to be dosed can be between 2 and 12, depending on the intended use, all components of the dosing system which come into contact with the preparations should be appropriately resistant to acid and alkali. Moreover, by choosing suitable materials, these components should be as far as possible chemically inert, for example towards non-ionic surfactants, enzymes and/or fragrances.

Cartridge

In the context of this application, the term "cartridge" is understood to mean a package that is suitable for encasing or holding together free-flowing or dispersible preparations, and that can be coupled with a dosing device to dispense the preparation.

In particular, a cartridge can also contain a plurality of chambers that can be filled up independently of each other with different preparations. It is also conceivable for a plurality of containers to be assembled into one cartridge unit.

The cartridge advantageously possesses at least one outlet that is arranged such that in the operating state of the dosing device the product can be released by gravity from the container. This ensures that additional means of conveyance for releasing the product out of the container are not needed, with the result that the dosing device is of a simple design and the production costs can be kept low.

In a preferred development of the invention, at least a second chamber for receiving at least one second free-flowing or dispersible product is provided, wherein the second chamber possesses at least one outlet that is arranged such that in the operating state of the dosing device the product can be released by gravity from the second chamber. The design of a second container is then particularly advantageous when preparations that are stored in the independent containers are not usually storage stable together, such as for example bleaching agents and enzymes.

Moreover, it is conceivable that more than two, in particular three to four chambers are provided in or on one cartridge. In particular, one of the chambers can be designed for dispensing volatile preparations, such as for example a fragrance, into the surroundings.

In a further development of the invention, the cartridges are integrally formed. In this way the cartridges can be made in a cost-effective manner in one production step, especially by an appropriate blow molding process. In this regard, the chambers of a cartridge can be separated from one another by partition walls or bridges of material.

The cartridges can also be manufactured in a multi-piece design by injection molding and subsequently formed from the assembled components.

Furthermore, it is conceivable for the cartridge to be formed in a multi-piece design such that at least one chamber, preferably all chambers, can be individually removed from or inserted into the dosing device. In this way it is possible, in the case of a differently high level of consumption of a preparation from one chamber, to exchange an already emptied chamber, whereas the others that still contain preparations in them remain in the dosing device. Thus a selected and as-needed refill of the individual chambers or their preparations can be carried out.

The chambers of a cartridge can be fastened to one another by suitable connection methods, thereby forming a container unit. The chambers can be fixed detachably or non-detachably to each other by means of an interlocking, friction locked and/or material joined connection. In particular, the connection can be made by one or more of the connecting types from the group of the snap-in connections, Velcro® fasteners, press-fitted assemblies, fused joints, adhesive joints, welded joints, soldered joints, screw connections, key joints, clamp joints or press stud connections. In particular, the connection can also be formed by means of a shrink sleeve that in a heated state is pulled, at least partially, over the cartridge and when cooled strongly envelops the chambers or the cartridge.

In order to provide advantageous emptying characteristics of the residues of the chamber, the floor of the chamber can be in the shape of a funnel inclined towards the outlet. Further, by the choice of suitable materials and/or surface characteristics, the interior wall of a chamber can be made in such a way that the product exhibits low material adhesion to the interior chamber wall. This technique also further optimizes the emptying of the remaining product from the chamber.

The chambers can have the same or different fill volumes. In a two-container configuration the ratio of the container volumes is preferably 5:1, in a three-container configuration preferably 4:1:1, these configurations being particularly suitable for use in automatic dishwashers.

As mentioned above, the cartridge preferably has 3 chambers. When employing this type of cartridge in an automatic dishwasher, it is particularly preferred that the first chamber contains an alkaline cleaning preparation, the second chamber contains an enzymatic preparation and the third chamber contains a rinse aid, wherein the volumetric ratio of the chambers is for example 4:1:1.

A dosing chamber can be designed in or on one chamber in the flow direction of the preparation before the outlet. The dosing chamber defines the amount of the preparation that is intended to be released from the chamber into the surroundings. This is then particularly advantageous when the closure element of the dosing device which effects the discharge of the preparation from a chamber into the surroundings, can be shifted only into a discharge and a closed position without controlling the discharge quantity. The dosing chamber then provides for a predefined quantity of preparation to be released, without a direct feedback of the defined quantity of dispensed preparation. The dosing chambers can be formed integrally or in multi parts.

According to another advantageous further development of the invention, one or more chambers each have, in addition to an outlet port, a liquid-tight closable chamber opening. This chamber opening allows for example the preparation that is kept in this chamber to be filled up.

Ventilation means can be provided, especially in the top portion of the cartridge, for ventilating the cartridge chambers in order to ensure a pressure equalization between the interior of the cartridge chambers and the surroundings as the filling level decreases in the chambers. These ventilation means can be designed for example as a valve, especially silicone valves, micro-openings in the cartridge wall or the like.

If, in accordance with another development, it is not intended to directly ventilate the cartridge chambers, but rather to provide ventilation through the dosing device or no ventilation at all, e.g. by using flexible containers, such as for example pouches, then this has the advantage that a pressure will be created at increased temperatures during a cleaning cycle of an automatic dishwasher as the contents of the chamber warm up, and said pressure pushes the preparations to be dosed in the direction of the outlet openings, such that the cartridge can be easily emptied of any residual preparation in this way. Furthermore, with an air-free packaging of this type there exists no danger of any oxidation of the substances in the preparation, thereby making a pouch packaging or even a bag in bottle packaging advantageously appropriate, especially for oxidation-sensitive preparations.

The cartridge usually has a filling volume (capacity) of <5000 ml, in particular <1000 ml, preferably <500 ml, particularly preferably <250 ml, quite particularly preferably <50 ml.

The cartridge can assume any shape. For example it can be in the shape of a cube, a sphere or a disc.

The shape of the cartridge and the dosing device can be designed in such a way that they take up as little useful volume as possible, especially in an automatic dishwasher.

For the use of the dosing device in automatic dishwashers, it is particularly advantageous to shape the dosing device as a function of the dishes to be cleaned in the automatic dishwasher. Thus, the dosing device can be designed for example in the shape of a disc, with approximately the dimensions of a plate. In this way the dosing device can be positioned in a space-saving way e.g. in the lower tray of the dishwasher. Moreover, due to the plate-like shape, the consumer can intuitively position the dosing unit correctly. The dimensions of the cartridge are preferably in the ratio height:width:depth between 5:5:1 and 50:50:1, particularly preferably about 10:10:1. In particular, the "slim" design of the dosing device and the cartridge allows the device to be positioned in the lower cutlery basket of an automatic dishwasher in the holding fixtures provided for the plates. This has the advantage that the preparations dispensed from the dosing device arrive directly into the wash liquor and cannot adhere to other articles being washed.

Typical commercial, domestic automatic dishwashers are designed such that larger items to be washed, for example pans or large plates, are placed in the lower tray of the dishwasher. In order to avoid that the consumer places the dosing system in a less than optimum position in the upper tray, then in an advantageous development of the invention, the dosing system is sized in such a way that it can be placed only in the holding fixtures provided for it in the lower tray. With this in mind, the width and the height of the dosing system can be chosen to be in particular between 150 mm and 300 mm, particularly preferably between 175 mm and 250 mm.

However, it is also conceivable to design the dosing unit in the form of a bowl with an essentially circular or rectangular base.

In order to protect heat-sensitive ingredients of a preparation in a cartridge against heat, the cartridge is advantageously manufactured from a material with a low thermal conductivity.

Another possibility for diminishing the action of heat on a preparation in a chamber of the cartridge is to insulate the chamber by suitable means, e.g. by using heat insulating materials such as for example Styropor, which suitably enclose the chamber or the cartridge either completely or partially.

In a preferred embodiment of the invention, the cartridge has an RFID-tag that at least has information about the contents of the cartridge and which can be read by the sensor unit.

This information can be used to select a dosing program stored in the control unit. This ensures that a dosing program optimized for a particular preparation is always used. In the absence of an RFID-label or with an RFID-label with false or incorrect recognition, it can be arranged that the dosing device does not dose but instead emits an optical or acoustic signal to inform the consumer of the fault.

In order to exclude any misuse of the cartridge, they can also possess structural elements that cooperate according to the lock and key principle with the corresponding elements of the dosing device, such that for example only cartridges of a particular type can be coupled with the dosing device. Moreover, this design ensures that information concerning the cartridges couple with the dosing device is communicated to the control unit, thereby enabling a coordinated control of the dosing device according to the contents of the corresponding container.

The cartridge is designed especially for receiving free-flowing washing or cleaning agents. This type of cartridge particularly preferably possesses a plurality of chambers for the spatially separate reception of each of the different preparations of a washing or cleaning agent.

The cartridge can be designed such that it can be releasably or fixedly arranged in or to the automatic dishwasher.

Dosing Device

The control unit, sensor unit as well as at least one actuator required for operation are integrated in the dosing device. An energy source is likewise preferably positioned in the dosing device.

The dosing device preferably consists of a housing that is impervious to water splashes and which prevents the ingress of water splashes into the interior of the dosing device, as can occur, for example, when the dosing device according to the invention is used in an automatic dishwasher.

It is particularly preferred that the dosing device comprises at least one first interface that interacts with a corresponding constructed interface located in or on a water-supplying device, such as in particular a water-supplying domestic appliance, preferably an automatic dishwasher or washing machine, such that a transfer of electrical energy from the water-supplying appliance to the dosing unit is realized.

In one development of the invention, the interfaces are formed by plug-in connectors. In another development, the interfaces can be designed such that a wireless transfer of electric energy is effected.

In an advantageous further development of the invention, a second interface is arranged on each dosing device and the water-supplying appliance, such as for example an automatic dishwasher, for transferring electromagnetic signals that in particular represent information on the operating state, measurement and/or control of the dosing device and/or of the water-supplying appliance such as an automatic dishwasher.

Adapter

A simple coupling of the dosing system to a water-supplying domestic appliance can be realized by means of an adapter. The adapter serves to link the mechanical and/or electrical connection of the dosing system with the water-supplying domestic appliance.

The adapter is preferably fixedly connected with a water-supplying pipe of the domestic appliance. However, it is also conceivable to provide the adapter to be placed in or on the household appliance, in which the adapter is protected from the flow of water and/or spray jet of the domestic appliance.

The adapter enables a dosing system to be designed both for a self-contained as well as a "built-in" version. It is also possible to design the adapter as a type of charging station for the dosing system in which for example the energy source of the dosing device is recharged or data are exchanged between the dosing device and the adapter.

The adapter can be placed in an automatic dishwasher on one of the interior walls of the washing chamber, in particular on the interior side of the door of the automatic dishwasher. However, it is also conceivable to place the adapter in the water-supplying household appliance where as such it is not accessible to the consumer, such that the dosing device is inserted into the adapter for example during the assembly of the household appliance, wherein the adapter, the dosing device and the household appliance are designed such that a cartridge from the consumer can be coupled with the dosing device.

The inventive cleaning agents, cleaning agent combinations or cleaning agent presentation forms are suitable for use in dish washing as well as for fabric cleaning; nonetheless the use of an inventive washing or cleaning agent preparation A, an inventive cleaning agent combination or an inventive cleaning agent presentation form for washing dishes in an automatic dishwasher process is preferred.

As stated in the introduction, the inventive cleaning agents are characterized by a particular physical and chemical stability, in particular towards temperature fluctuations. Accordingly, the inventive cleaning agents are exceptionally suitable for dosing by means of a dosing system that is located in the interior of a washing machine or automatic dishwasher. Such a dosing system that can be fixedly integrated in the interior of the washing machine or automatic dishwasher (machine-integrated dosing device) but can of course also be inserted as a movable device into the interior (self-contained dosing device), comprises a multiple of the amount of the cleaning agent required for carrying out an automatic cleaning process.

In the context of this application, "movable" means that the dispensing and dosing system is not non-detachably connected with a device, such as for example an automatic dishwasher, washing machine, washer dryer or the like, but rather can be removed for example from an automatic dishwasher or can be placed in an automatic dishwasher.

The use of a liquid washing or cleaning agent preparation A or of a cleaning agent combination according to one of the preceding claims for filling i) a cartridge of a dosing system fixedly integrated into the interior of an automatic dishwasher or fabric washing machine or ii) a movable cartridge of a dosing system designed to be placed in the interior of an automatic dishwasher or fabric washing machine with a sufficient amount of this liquid washing or cleaning agent preparation or of this cleaning agent combination for carrying out at least two, preferably at least four and in particular at least eight automatic dishwasher processes or automatic fabric washing processes, are likewise subject matters of this application.

An example of an immovable cartridge is a container that is immovably integrated into the interior, for example into the side wall or into the interior casing of the door of an automatic dishwasher.

An example of a movable cartridge is a container that is inserted into the interior of the automatic dishwasher or of the fabric washing machine by the consumer and that remains there during the complete course of a cleaning cycle. Such a cartridge can for example be integrated into the interior by simply placing it into the cutlery tray or dish tray but can also be removed again from the interior of the automatic dishwasher by the consumer.

The cleaning agent or the cleaning agent combination is dosed from the cartridge into the interior of the automatic dishwasher or fabric washing machine as described above, preferably by means of a dosing device that can be detached from the cartridge. A dosing device of this type can be connected to the cartridge by means of an adhesive bond, a latch connection, a snap-in connection or push-fit connection. Of course, cartridges with an undetectably connected dosing device can also be employed.

The use of an inventive cleaning agent presentation form, comprising a) an inventive washing or cleaning agent preparation A in a sufficient amount for carrying out at least two, preferably at least four and in particular at least eight automatic dishwasher processes or automatic fabric washing processes;

b) a cartridge for the washing or cleaning agent preparation A as the cleaning agent reservoir for i) a dosing device that is fixedly integrated into the interior of an automatic dishwasher or fabric washing machine or ii) a moveable dosing device designed to be placed in the interior of an automatic dishwasher or fabric washing machine are likewise subject matters of this application.

The use of an inventive cleaning agent dosing system as the cleaning agent reservoir for an automatic dishwasher or fabric washing machine is another subject matter of the present application.

Two further subject matters of this application are the use of an inventive cleaning agent presentation form, comprising a) an inventive washing or cleaning agent preparation A in a sufficient amount for carrying out at least two, preferably at least four and in particular at least eight automatic dishwasher processes or automatic fabric washing processes;

b) at least one additional washing or cleaning agent preparation B that differs from A in a sufficient amount for carrying out at least two, preferably at least four and in particular at least eight automatic dishwasher processes or automatic fabric washing processes;

c) a cartridge for the washing or cleaning agent preparations A and B, in which said washing or cleaning agent preparations A and B are in separate receiving chambers, as the cleaning agent reservoir for i) a dosing device that is fixedly integrated into the interior of an automatic dishwasher or fabric washing machine or ii) a moveable dosing device designed to be placed in the interior of an automatic dishwasher or fabric washing machine.

Claimed in addition is the use of an inventive cleaning agent presentation form, comprising a) an inventive washing or cleaning agent preparation A in a sufficient amount for carrying out at least two, preferably at least four and in particular at least eight automatic dishwasher processes;

b) at least one additional washing or cleaning agent preparation B that differs from A in a sufficient amount for carrying out at least two, preferably at least four and in particular at least eight automatic dishwasher processes;

c) at least one additional washing or cleaning agent preparation C that differs from A and B in a sufficient amount for carrying out at least two, preferably at least four and in particular at least eight automatic dishwasher processes;

d) a cartridge for the washing or cleaning agent preparations A, B and C, in which said washing or cleaning agent preparations A, B and C are in separate receiving chambers, as the cleaning agent reservoir for i) a dosing unit that is fixedly integrated inside an automatic dishwasher or ii) a moveable dosing device that is designed to be placed inside an automatic dishwasher.

The inventive cleaning agents and cleaning agent combinations, as already stated, are preferably employed as an automatic dishwashing agent or as an automatic fabric washing agent.

Inventive automatic dishwasher processes and fabric washing processes employing an inventive washing or cleaning agent preparation A are characterized in that in the course of these processes a partial amount a of the washing or cleaning agent A present in a cartridge that is in the interior of the automatic dishwasher or fabric washing machine is dosed from the cartridge into the interior of the automatic dishwasher or fabric washing machine, wherein a residual amount of the cleaning agent present in the cartridge remains in the cartridge up to the end of the dishwashing or fabric washing process, wherein said residual amount corresponds to at least the double, preferably at least four times and in particular at least eight times the amount of the partial amount a.

Of course, not only the inventive cleaning agent, but also the above described inventive cleaning agent combinations or cleaning agent presentation forms or cleaning agent dosing systems can be employed in the inventive dishwasher processes or fabric washing processes.

Accordingly, another subject matter of this application is an automatic dishwasher process or automatic fabric washing process using an inventive cleaning agent combination, comprising an inventive cleaning agent A as well as an additional cleaning agent B that differs from A, in which process a partial amount a of the washing or cleaning agent A present in the cartridge that is in the interior of the automatic dishwasher or fabric washing machine as well as additionally a partial amount b of the washing or cleaning agent B present in the cartridge is dosed from the cartridge into the interior of the automatic dishwasher, wherein residual amounts of the cleaning agents A and B present in the cartridge remain in the cartridge up to the end of the dishwashing process or fabric washing process, and the residual amount of the cleaning agent A corresponds to at least the double, preferably at least four times and in particular at least eight times the amount of the partial amount a and the residual amount of the cleaning agent B corresponds to at least the double, preferably at least four times and in particular at least eight times the amount of the partial amount b.

Accordingly, another subject matter of this application is an automatic dishwasher process or automatic fabric washing process using an inventive cleaning agent combination, comprising an inventive cleaning agent A as well as an additional cleaning agent B that differs from A and a third cleaning agent that differs from A and B, in which process a partial amount a of the washing or cleaning agent A present in the cartridge that is in the interior of the automatic dishwasher or fabric washing machine as well as a partial amount b of the washing or cleaning agent B present in the cartridge and additionally a partial amount c of the cleaning agent C in the cartridge is dosed from the cartridge into the interior of the automatic dishwasher or fabric washing machine, wherein residual amounts of the cleaning agents A, B and C present in the cartridge remain in the cartridge up to the end of the dishwashing process or fabric washing process, and the residual amount of the cleaning agent A corresponds to at least the double, preferably at least four times and in particular at least eight times the amount of the partial amount a and the residual amount of the cleaning agent B corresponds to at least the double, preferably at least four times and in particular at least eight times the amount of the partial amount b and the residual amount of the cleaning agent C corresponds to at least the double, preferably at least four times and in particular at least eight times the amount of the partial amount c.

If cleaning agent combinations having two, three or more different cleaning agents are employed in the inventive automatic dishwasher process or automatic fabric washing process, then the different cleaning agents are preferably dosed at different times in the cleaning cycle.

Accordingly, another subject matter of this application is an automatic dishwasher process or automatic fabric washing process using an inventive cleaning agent or an inventive cleaning agent combination or an inventive cleaning agent presentation form or an inventive cleaning agent dosing system, in the course of which a) at a time t1 a partial quantity a of the inventive washing or cleaning agent preparation A is dosed into the interior of the automatic dishwasher from the cartridge that is present in the interior of the automatic dishwasher or fabric washing machine, wherein a residual amount of the cleaning agent A present in the cartridge remains in the cartridge up to the end of the dishwashing process or fabric washing process and corresponds to at least the double, preferably at least four times and in particular at least eight times the amount of the partial amount a;

b) at least at another time t2≠t1 a partial quantity b of the inventive washing or cleaning agent preparation B that is different from the inventive washing or cleaning agent preparation A is dosed into the interior of the automatic dishwasher or fabric washing machine from the second cartridge that is present in the interior of the automatic dishwasher, wherein a residual amount of the cleaning agent present in this cartridge remains in the cartridge up to the end of the dishwashing process and corresponds to at least the double, preferably at least four times and in particular at least eight times the amount of the partial amount b.

This application further claims an automatic dishwasher process or automatic fabric washing process using an inventive cleaning agent or an inventive cleaning agent combination or an inventive cleaning agent presentation form or an inventive cleaning agent dosing system, in the course of which a) at a time t1 a partial quantity a of the inventive washing or cleaning agent preparation A is dosed into the interior of the automatic dishwasher or fabric washing machine from the cartridge that is present in the interior of the automatic dishwasher or fabric washing machine, wherein a residual amount of the cleaning agent A present in the cartridge remains in the cartridge up to the end of the dishwashing process or fabric washing process and corresponds to at least the double, preferably at least four times and in particular at least eight times the amount of the partial amount a;

b) at least at another time t2≠t1 a partial quantity b of the inventive washing or cleaning agent preparation B that is different from the inventive washing or cleaning agent preparation A is dosed into the interior of the automatic dishwasher or fabric washing machine from the second cartridge that is present in the interior of the automatic dishwasher or fabric washing machine, wherein a residual amount of the washing or cleaning agent B present in this cartridge remains in the cartridge up to the end of the dishwashing process or fabric washing process and corresponds to at least the double, preferably at least four times and in particular at least eight times the amount of the partial amount b;

c) at least at another time t3≠t2≠t1 a partial quantity c of the inventive washing or cleaning agent preparation C that is different from the inventive washing or cleaning agent preparation A and from the inventive washing or cleaning agent B is dosed into the interior of the automatic dishwasher or fabric washing machine from the third cartridge that is present in the interior of the automatic dishwasher or fabric washing machine, wherein a residual amount of the cleaning agent C present in this cartridge remains in the cartridge up to the end of the dishwashing process or fabric washing process and corresponds to at least the double, preferably at least four times and in particular at least eight times the amount of the partial amount c.

In preferred embodiments of the above described automatic dishwasher processes or fabric washing processes with time-delayed dosing of the washing or cleaning agent preparations A and B or A, B and C, the time t2 is at least 1 minute, preferably at least 2 minutes and especially between 3 and 20 minutes before or after the time t1.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. An automatic dishwasher process or automatic fabric washing method comprising:

dosing a partial amount a of a cleaning agent from a cartridge, inside an automatic dishwasher or fabric washing machine, into an interior space of the automatic dishwasher or fabric washing machine, the cleaning agent comprising:

a) at least 5 wt.% of at least one active washing or cleaning enzyme preparation, and b) at least 0.5 wt.% cumene sulfonate, wherein a residual amount of the cleaning agent present in the cartridge remains in the cartridge up to the end of the dishwashing process or fabric washing process, wherein said residual amount corresponds to at least double the partial amount.

2. The method according to claim 1, wherein the enzyme preparation comprises at least one active washing or cleaning enzyme selected from the group consisting of amylases and proteases.

3. The liquid washing or cleaning agent preparation according to claim 2, comprising 0.1 to 30 wt.% amylase preparation relative to the total weight of the washing or cleaning agent preparation.

4. The liquid washing or cleaning agent preparation according to claim 2, comprising 5 to 50 wt.% protease preparation relative to the total weight of the washing or cleaning agent preparation.

5. The liquid washing or cleaning agent preparation according to claim 1, comprising 0.5 to 60 wt.% cumene sulfonate relative to the total weight of the washing or cleaning agent preparation.

6. The liquid washing or cleaning agent preparation according to claim 1, further comprising an organic solvent.

7. The liquid washing or cleaning agent preparation according to claim 6, wherein the organic solvent comprises 1,2-propylene glycol and is included at a weight fraction of 5 to 80 wt.% relative to the total weight of the washing or cleaning agent preparation.

8. The liquid detergent or cleaning agent preparation according to claim 1, further comprising a non-ionic surfactant included at a weight fraction of 0.5 to 30 wt.% relative to the total weight of the washing or cleaning agent preparation.

* * * * *